United States Patent [19]

Takahashi et al.

[11] 4,448,174

[45] May 15, 1984

[54] DISTRIBUTOR TYPE FUEL INJECTION PUMP ADAPTABLE TO INTERNAL COMBUSTION ENGINES WITH A WIDE RANGE OF THE NUMBER OF CYLINDERS

[75] Inventors: Seizi Takahashi; Hachiro Aoki, both of Matsuyama, Japan

[73] Assignee: Diesel Kiki Co., Ltd., Tokyo, Japan

[21] Appl. No.: 467,787

[22] Filed: Feb. 18, 1983

[51] Int. Cl.[3] ..... F02M 59/20

[52] U.S. Cl. ..... 123/502; 417/462

[58] Field of Search ..... 123/501, 502, 449; 417/462

[56] References Cited

U.S. PATENT DOCUMENTS

| | | | |
|---|---|---|---|
| 2,999,487 | 9/1961 | Stier et al. | 123/502 |
| 4,177,775 | 12/1979 | Hofer et al. | 123/502 |
| 4,329,962 | 5/1982 | Johnston | 123/502 |
| 4,387,688 | 6/1983 | Gheim | 123/502 |

*Primary Examiner*—Ira S. Lazarus
*Assistant Examiner*—Magdalen Moy
*Attorney, Agent, or Firm*—Frishauf, Holtz, Goodman & Woodward

[57] ABSTRACT

A distributor type fuel injection pump which is provided with an eccentric connecting member coupling the timer piston of the injection timing control device to the roller holder. The eccentric connecting member comprises a first portion and a second portion eccentrically combined together. The first portion engages with the roller holder to support a predetermined one of the rollers on the roller holder, which is rotatably fitted thereon, whereas the second portion pivotably engages with the timer piston. Displacement of the timer piston causes corresponding circumferential displacement of the roller holder through the eccentric connecting member to thereby vary the fuel injection timing.

8 Claims, 10 Drawing Figures

DISTRIBUTOR TYPE FUEL INJECTION PUMP ADAPTABLE TO INTERNAL COMBUSTION ENGINES WITH A WIDE RANGE OF THE NUMBER OF CYLINDERS

BACKGROUND OF THE INVENTION

This invention relates to a distributor type fuel injection pump for internal combustion engines, and more particularly to a fuel injection pump of this type which can be adapted for use with internal combustion engines with a wide range of the number of cylinders.

In a distributor type fuel injection pump for Diesel engines, it is necessary to vary the fuel injection timing in dependence upon the rotational speed of the engine so as to inject fuel into each engine cylinder at an appropriate time relative to the position of the piston in the cylinder. To this end, the conventional fuel injection pump is provided with an injection timing control device generally called "a timer". A distributor type fuel injection pump provided with such injection timing control device generally includes a drive shaft arranged for rotation at speeds dependent upon the engine rotational speed, a pumping plunger rotatatively coupled to the drive shaft, a cam disc secured to one end of the plunger, a roller holder carrying a plurality of rollers disposed in urging contact with the cam disc and allowed to rotate through a limited angle, and a timer piston drivingly coupled to the roller holder and actuatable in response to fuel oil pressure variable in response to the engine rotational speed. The fuel injection pump operates such that when the drive shaft rotates at speeds dependent upon the engine rotational speed, the plunger is made to rotate and reciprocate at the same time due to the action of the mutually engaging cam disc and rollers, while simultaneously a change in the fuel oil pressure dependent upon the engine rotational speed causes displacement of the timer piston, which in turn causes circumferential displacement of the roller holder, resulting in a change in the position of contact between the rollers on the roller holder and the cam disc so that the acting point of the plunger changes with respect to the circumferential phase of the drive shaft to thereby control the fuel injection timing.

It is a general tendency in recent years for Diesel engines to become more compact in size. For instance, Diesel engines having a total stroke volume of the order of 1,000 cc are under development. In many cases, such compact Diesel engines are designed with three cylinders, depending upon their use. Also fuel injection pumps to be applied to such three-cylinder Diesel engines have to be designed as the three-cylinder type.

However, conventional distributor type fuel injection pumps are very difficult to convert into the three-cylinder type, owing to its structural handicap. That is, to convert a fuel injection pump of this type into the three-cylinder type, three rollers, which are to engage with the cam disc, have to be arranged on the roller holder at circumferentially equal intervals, i.e. intervals of 120 degrees. However, the roller holder has its upper edge portion formed with a large cut for avoiding interference of the roller holder with its adjacent parts. Further, the roller holder has its lower central edge portion occupied by a connecting lever which couples the roller holder with the timer piston. Therefore, it is impossible to arrange one of the three rollers either at the upper edge portion of the roller holder or at the lower central edge portion of same.

In view of this structural handicap, it has conventionally been employed to convert a distributor type fuel injection pump for six-cylinder type engines into the three-cylinder type in such a manner that a communication groove or cutting is formed in tip of the plunger, which extends between adjacent ones of every other pair of six suction slits formed in the same tip. However, this converted fuel injection pump has various disadvantages such as a limited choice in designing the camming surface of the cam disc disposed opposite the rollers, a limited maximum advance in the fuel injection timing, and a too narrow distance between the adjacent suction slits in the plunger, leading to degradated airtightness between the plunger and the plunger barrel.

Under the circumstances, keenly desired is the appearance of a distributor type fuel injection pump for exclusive use with a three-cylinder engine.

SUMMARY OF THE INVENTION

It is the object of the invention to adapt a conventional distributor type fuel injection pump to internal combustion engines with any number of cylinders inclusive of the three-cylinder type without requiring any modification of the other component parts of the pump, by employing a peculiar element which can supersede one of the pins or shafts supporting the rollers on the roller holder and the connecting lever coupling the roller holder with the timer piston.

According to the present invention, connecting means coupling the roller holder with an element (timer piston) of the fuel injection timing control device, which is displaceable in response to the rotational speed of the engine, comprises an eccentric member having a first portion and a second portion eccentrically combined together. The first portion of the connecting means engages with the roller holder and supports a predetermined one of the rollers carried on the roller holder, which is rotatably fitted on the first portion, whereas the second portion pivotably engages with the above displaceable element of the fuel injection timing control device. Displacement of the displaceable member causes corresponding displacement of the roller holder through the eccentric member of the connecting means to thereby change the injection timing of fuel into the engine.

The above and other objects, features and advantages of the invention will be more apparent from the ensuing detailed description taken in connection with the accompanying drawings.

DETAILED DESCRIPTION

Figure 1:
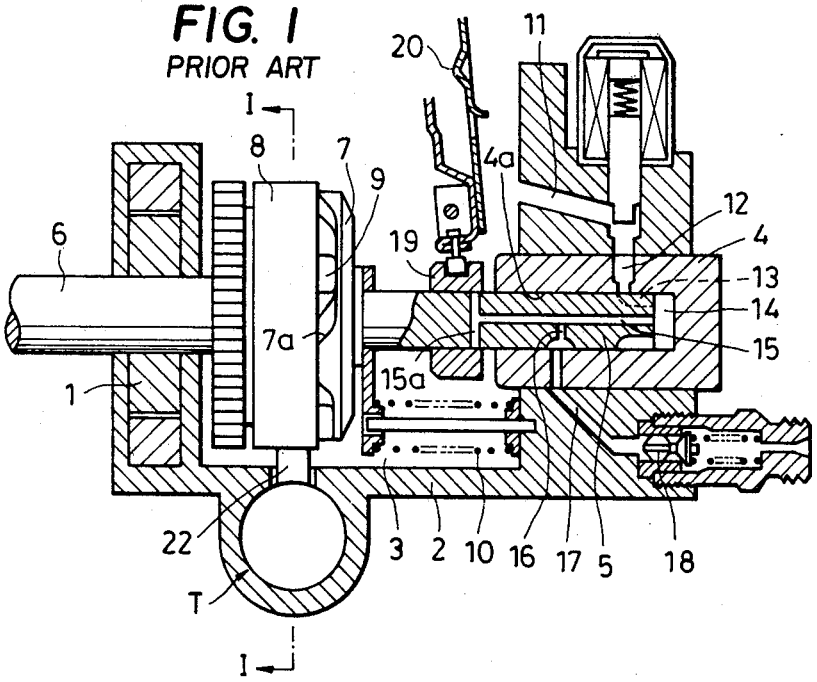
FIG. 1 PRIOR ART
FIG. 1 is a longitudinal sectional view of essential part of a conventional distributor type fuel injection pump to which the present invention is applicable.
Figure 2:
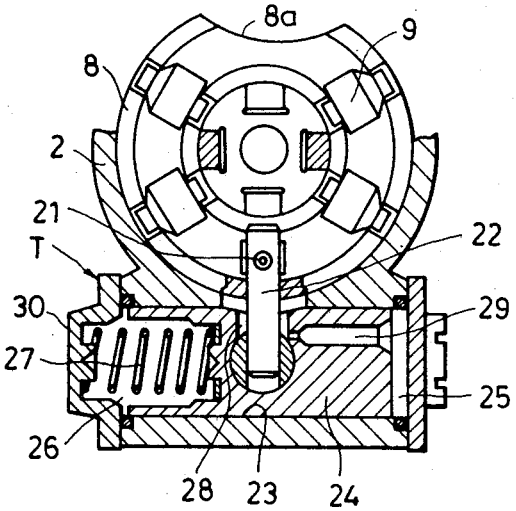
FIG. 2 PRIOR ART
FIG. 2 is a sectional view taken along line I—I in FIG. 1.

Referring first to FIGS. 1 and 2, there is illustrated a distributor type fuel injection pump which is conventionally used. Fuel oil in a fuel tank, not shown, is sucked and pressurized by a feed pump 1, and delivered to a suction chamber 3 defined within a pump housing 2. The internal pressure or fuel pressure within the suction chamber 3 is controlled to a value dependent upon the rotational speed of an engine associated with the pump, by means of a pressure regulating valve, not shown, such that the internal pressure increases proportionately to an increase in the engine rotational speed, for instance.

A pumping plunger 5 for pumping and distributing actions is slidably received within a cylinder bore 4*a* formed within a plunger barrel 4 mounted in the pump housing 2, to make simultaneous reciprocating and rotative motions by means described below. A drive shaft 6 is drivingly coupled to a cam disc 7 secured to the rear end of the plunger 5, by means of a driving disc, not shown, such that the plunger 5 rotates in unison with the rotating drive shaft 6. The cam disc 7 has a camming surface 7*a* formed with highs corresponding in number to the cylinders of the engine (four in the illustrated embodiment), which surface is urged against four rollers 9 carried on a roller holder 8 and circumferentially arranged, by a spring 10. Thus, as the drive shaft 6 rotates, the plunger 5 is caused to make a reciprocating motion for suction and pressure delivery of fuel and a rotative motion for distribution of fuel to delivery valves 18, at the same time.

When the plunger 5 is moved through each suction stroke, fuel in the suction chamber 3 is supplied into a pump working chamber 14 through a fuel feeding line 11, a suction port 12, and one of suction grooves 13 formed in the outer peripheral surface of tip of the plunger 5 and then registering with the suction port 12. When the plunger is moved through the following delivery stroke, the suction port 12 and the above suction groove 13 are disconnected from each other by the plunger 5 so that the fuel in the pump working chamber 14 is pressurized to be fed through a central axial bore 17 and a distributing port 16, both formed in the plunger 5, and through one of passages 17 and one of the delivery valves 8, both corresponding in number to the engine cylinders and provided in the pump housing 2, to be injected into one of the engine cylinders through an injection nozzle, not shown.

A control sleeve 19 is slidably fitted on a portion of the plunger 5 projected into the suction chamber 3. During the delivery stroke of the plunger 5, when a cut-off port 15*a* formed in the plunger 5 in communication with the central axial bore 15 becomes disengaged from the control sleeve 19 to open into the suction chamber 3, the pressurized fuel within the plunger 5 flows into the suction chamber 3 to interrupt the delivery of fuel to the delivery valve 18, terminating the injection. The control sleeve 19 is controlled in axial position on the plunger 5 by means of a governor mechanism, not shown, engaging with the control sleeve via a lever 20, etc. to thereby control the fuel injection quantity.

The roller holder 8 is arranged in concentricity with the plunger 5 and rotatable about its own axis through a limited angle. A connecting lever 22 is connected at its one end to the roller holder 8, and at its other end to the timer piston 24 of an injection timing control device T.

The injection timing control device T is constructed such that the timer piston 24 is slidably received within a cylinder 23 formed at the bottom of the pump housing 2 and extending at right angles to the axis of the roller holder 8, and defined within the cylinder 23 at opposite ends of the piston 24 are a pressure working chamber 25 into which the fuel pressure is supplied from the suction chamber 3, and a chamber 26 in which a timer spring 27 is accommodated. The position of the timer piston 24 is determined by the relationship between the force of the timer spring 27 and the fuel pressure, which in turn determines the circumferential position of the roller holder 8 through the connecting lever 22. A change in the circumferential position of the roller holder 8 causes a change in the position of contact between the rollers 9 and the camming surface 7*a* of the cam disc 7, which in turn causes a change in the relationship between the circumferential phase of the drive shaft 6 and the above position of contact, i.e. the acting point of the plunger 5, so that there occurs a change in the injection timing with respect to the angle of rotation of the drive shaft 6. For instance, when an increase in the fuel pressure forces the timer piston 24 to be moved against the force of the timer spring 27 in a direction normal to the axis of the roller holder 8, the roller holder 8 is rotated clockwise as viewed in FIG. 2 to advance the injection timing.

To design the above-mentioned conventional distributor type fuel injection pump for use with a three-cylinder engine, it is necessary to arrange three rollers 9 on the roller holder 8 at circumferentially equal intervals. However, as shown in FIG. 2, an arcuate notch 8*a* is formed in an upper edge portion of the roller holder 8 to avoid interference of the roller holder 8 with a coupling gear, not shown, which drivingly couples the drive shaft 6 with the governing mechanism, not shown, which makes it impossible to arrange a roller at the above upper edge portion. In addition, as stated above, in the case of the three-cylinder type, three rollers have to be arranged on the roller holder at circumferentially equal intervals of 120 degrees. To satisfy this requirement with the above notched roller holder 8, two of the three rollers have to be located at the opposite sides of the notch in the upper edge portion and one at a central lower edge portion of the roller holder 8, respectively. However, the presence of the aforementioned connecting lever 22 coupling the roller holder 8 with the timer piston 24 prevents arrangement of one of the rollers at the central lower edge portion of the roller holder 8. Under these circumstances, no distributor type fuel injection pump has so far been developed for exclusive use with three-cylinder engines.

Figure 3:
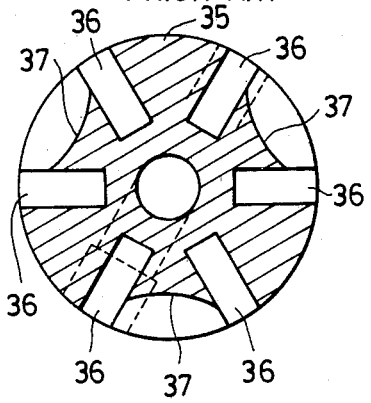
FIG. 3 PRIOR ART
FIG. 3 is a cross-sectional view of a plunger used in a conventional distributor type fuel injection pump for three-cylinder engines.

Therefore, as tentative measures, a distributor type fuel injection pump for a six cylinder engine is actually used for a three-cylinder engine. More specifically, as shown in FIG. 3, communication or spill grooves 37 are formed in tip of the plunger 5 in a manner each extending between adjacent ones of every other pair of six suction slits formed in the same tip, so that fuel in the pump working chamber 14 is allowed to escape through the communication grooves 37 into the fuel feeding line 11 during three of the six delivery strokes, thus enabling the injection pump to act substantially as a three-cylinder type.

According to the above converted injection pump for three-cylinder engines, many or six rollers are circumferentially arranged on the roller holder, which imposes a limitation upon free designing of the camming surface of the cam disc, for instance, due to limited arrangement of highs on the camming surface, and also impedes designing the cam lift large, leading to a low maximum rpm. Further, it also makes it impossible for the injection timing control device to have a large maximum advance in the injection timing. In addition, the surface area of the plunger 5 occupied by the suction slits 36 is large, reducing the airtightness between the outer peripheral surface of the plunger 5 and the inner wall of the plunger barrel 4, resulting in low injection pressure. Still further, while the plunger 5 apparently carries out six delivery strokes per rotation, three of these delivery strokes are actually ineffective due to the presence of the spill grooves 37 in the plunger 5, which means large loss of energy of the engine driving the pump.

In the light of various disadvantages with the conventional three-cylinder type injection pump stated above, the appearance of an exclusive three-cylinder type injection pump is keenly desired.

FIGS. 4 through 10 illustrate an embodiment of the present invention. The other parts of the injection pump than those illustrated in these figures are substantially identical with those of the conventional distributor type fuel injection pump in FIGS. 1 and 2, except ones specifically referred to hereinafter, description and illustration of which are, therefore, omitted here.

Figure 4:
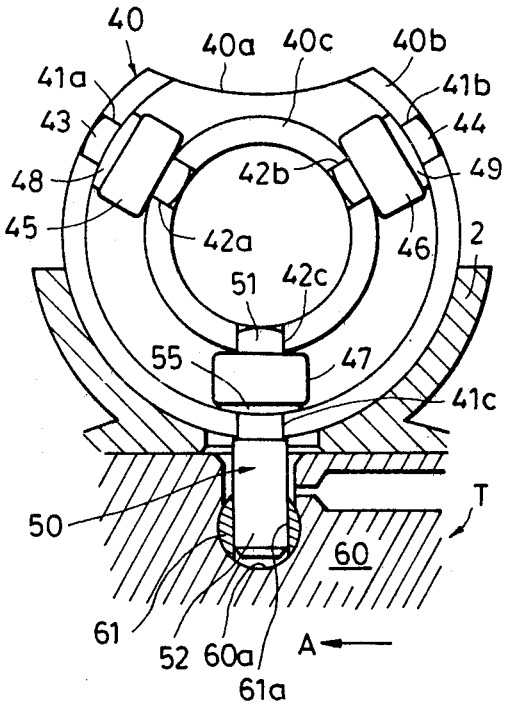
FIG. 4 is a sectional view of essential part of a distributor type fuel injection pump according to an embodiment of the present invention.

In FIG. 4, the roller holder 40 is formed with a generally arcuate notch 40*a* in its upper edge portion for avoiding interference of the roller holder 40 with the coupling gear coupling the drive shaft with the governor mechanism, as in the conventional pump. The roller holder 40 comprises an annular outer holding portion 40*b* and an inner annular holding portion 40*c* arranged concentrically with each other. These holding portions 40*b*, 40*c* have their one side surfaces each formed with three slits 41*a*–41*c* and 42*a*–42*c*, which extend radially of the roller holder 40 and are circumferentially arranged at predetermined intervals, e.g. at equal intervals of 120 degrees. Each of the slits 41*a*–41*c* are disposed opposite a corresponding one of the slits 42*a*–42*c*. Of these slits, the paired slits 41*a*, 42*a* and 41*b*, 42*b* are located at circumferentially opposite sides of the notch 40*a*, while the paired slits 41*c*, 42*c* are located at a central lower edge portion of the roller holder 40 which is diametrically opposite to the notch 40*a*. Fitted in the slits 41*a*, 42*a* and 41*b*, 42*b* are end portions of roller shafts 43 and 44, which support respective rollers 45 and 46 rotatably fitted thereon. Annular washers 48 and 49 are fitted on the outer end portions of the roller shafts 43, 44 and interposed between the rollers 45, 46 and the inner wall surface of the outer holding portion 40*b* to prevent direct sliding contact of the rollers 45, 46 with the inner wall surface of the outer holding portion 40*b*. The rollers 45, 46 can be mounted onto the roller holder 40 in the same manner as in the conventional pump.

Figure 5:
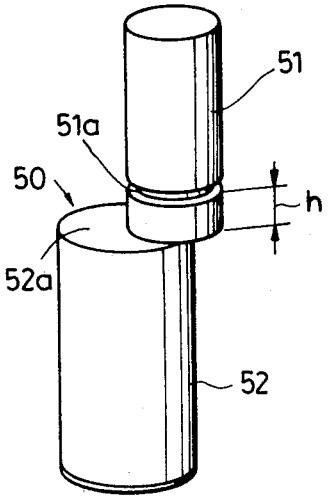
FIG. 5 is a perspective view of an eccentric member seen in FIG. 4.

An eccentric connecting member 50 is connected between the roller holder 40 and the timer piston 60 of the injection timing control device T in a manner fitted in the slits 41*c*, 42*c* and the piston 60. As shown in FIG. 5, the eccentric connecting member 50 comprises a cylindrical upper half portion 51 and a cylindrical lower half portion 52 which are joined together at ends in eccentricity with each other. Preferably, the two portions 51, 52 are integrally formed in one piece. The upper half portion 51 has its lower end portion formed with a circumferentially extending annular groove 51*a*. The upper half portion 51 is intended to support the roller 47 fitted thereon and has such a length and a diameter as to be snugly fit into the slits 41*c*, 42*c*. A snap ring 55 is fitted in the annular groove 51*a* in a manner interposed between the roller 47 and the inner wall surface of the outer holding portion 40*b*. The lower half portion 52 is intended to couple the timer piston 60 of the injection timing control device T in FIG. 4 with the roller holder 40. As shown in FIG. 4, the lower half portion 52 has its lower end portion fitted in an engaging hole 61*a* formed in a holder 61 placed within an engaging hole 60*a* formed in a portion of the peripheral surface of the piston 60 opposite the roller holder 40, the holder 61 being in spherical contact with the engaging hole 60*a* for swivelling motion therein.

Figure 6:
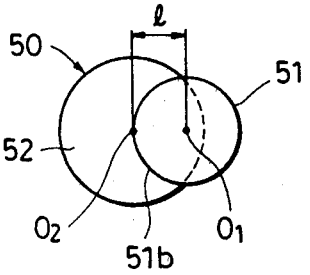
FIG. 6 is an end view of the eccentric member of FIG. 5.

The degree of eccentricity of the upper and lower half portions 51, 52 of the eccentric connecting member 50, that is, the distance between the diametric center $O_1$ of the upper half portion 51 and the diametric center $O_2$ of the lower half portion 52 as shown in FIG. 6 is determined by the positional relationship between the roller holder 40 and the timer piston 60 of the injection timing control device T, the diameters of the upper and lower half portions 51, 52, etc. In the illustrated embodiment, the upper and lower half portions 51, 52 are so arranged that the peripheral lateral surface of the upper half portion 51 is located just on the diametric center $O_2$ of the lower half portion 52. Further, in the illustrated embodiment, the outer diameter of the upper half portion 51 is smaller than that of the lower half portion 52, and also the distance between an upper or inner end face 52*a* of the lower half portion 52 and the lower edge of the annular groove 51*a* of the upper half portion 51 is set slightly larger than the wall thickness of the outer holding portion 40*b* of the roller holder 40. The eccentric connecting member 50 with the above described configuration is preferably formed of the same material as the roller shafts 43, 44.

Figure 7:
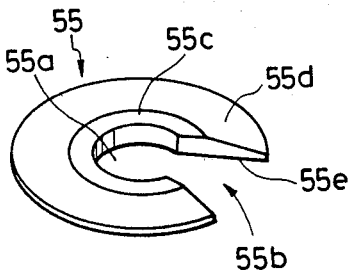
FIG. 7 is a perspective view of a snap ring fitted on the eccentric member.
Figure 8:
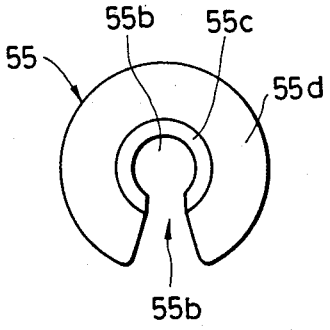
FIG. 8 is a top plan view of the snap ring of FIG. 7.

As shown in FIGS. 7 and 8, the snap ring 55 has a flat marginal edge portion 55*c* surrounding its central through hole 55*a*, which has a wall thickness slightly smaller than the width of the groove 51*a* in the roller shaft 51. A side surface 55*d* of the snap ring 55 is generally tapered from the above marginal edge portion 55*c* to the outer peripheral edge with a slope nearly equal to the slope of the inner wall surface of the outer holding portion 40*b* of the roller holder 40. The snap ring 55 can be force fitted into the annular groove 51*a* in the upper half portion 51, through a side opening or notch 55*b* extending from the outer peripheral edge to the central hole 55*a*. The snap ring 55 is preferably formed of a plate material having elasticity, such as steel, like an ordinary snap ring.

Figure 9:
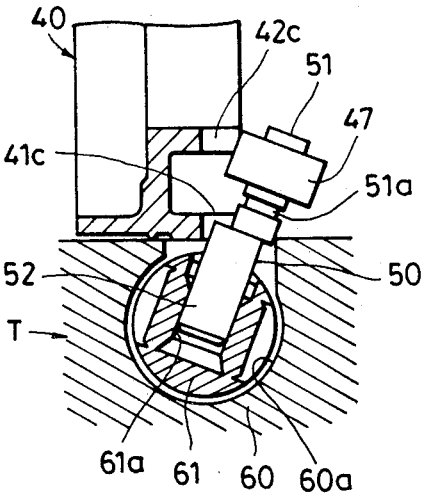
FIG. 9 is a fragmentary sectional view of the roller holder, the timer piston and the eccentric member being mounted onto them.
Figure 10:
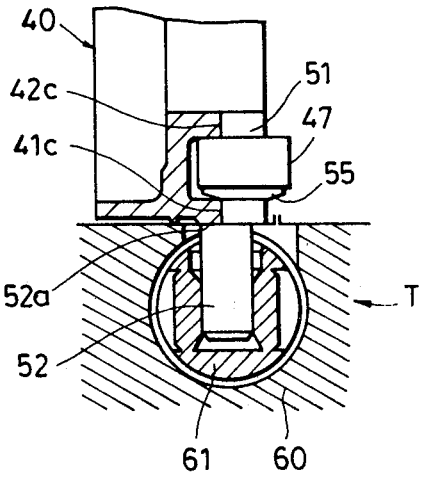
FIG. 10 is a view similar to FIG. 9, with the eccentric member mounted on the roller holder and the timer piston.

To put the roller holder 40 and the timer piston 60 together by the use of the eccentric connecting member 51, first, as shown in FIG. 9, the lower half portion 52 of the eccentric connecting member 50 is made to engage the timer piston 60 by fitting its lower end portion into the engaging hole 61*a* in the holder 61 slidably fitted within the engaging hole 60*a* in the piston 60, and then the roller 47 is fitted onto the upper half portion 51 of the eccentric connecting member 50. Then, the upper part of the eccentric member 50 is turned about the holder 61 toward the roller holder 40, followed by fitting opposite end portions of the upper half portion 51 into the mutually opposite slits 41*c*, 42*c* in the outer and inner holding portions 40*b*, 40*c* of the roller holder 40 to thus rotatably retain the roller 47 between the two holding portions 40*b*, 40*c*. On this occasion, the eccentric connecting member 50 should be positioned so that the direction of eccentricity of the upper and lower half portions 51, 52 of the eccentric connecting member 50 is substantially identical with the axis of the roller holder 40, that is, at right angles to the axis (the moving direction) of the timer piston 60. Thereafter, as shown in FIG. 10, the snap ring 55 is force fitted into the annular groove 51*a* of the upper half portion 51 so that it becomes interposed between the inner end face of the roller 47 and the inner wall surface of the outer holding portion 40*b* of the roller holder 40. On this occasion, the snap ring 55 should be positioned so that its tapered side surface 55*d* faces the inner wall surface of the outer holding portion 40*b*, and its other or opposite side surface 55*e* (FIG. 7) the lower end face of the roller 47, respectively.

In this state, the inner or upper end face of the lower half portion 52 of the eccentric connecting member 50 is disposed in softly urging contact with the outer peripheral surface of the roller holder 40 so that the roller 47 is supported on the upper half portion 51 rotatably thereabout. The eccentric connecting member 50 is no more rotatable about its own axis due to the eccentricity of the upper and lower half portions 51, 52. In the above described manner, the roller 47 can be supported on the roller holder 40 and simultaneously the roller holder 40 and the injection timing control device T can be coupled together, by means of the single eccentric connecting member 50. That is, according to the invention, three rollers 45–47 can be circumferentially arranged at equal intervals of 120 degrees, while allowing the coupling of the roller holder 40 with the injection timing control device T. It goes without saying that in the present embodiment, though not illustrated, three slits are formed in tip of the plunger, not shown, and three highs on the camming surface of the cam disc, not shown, on the other end of the plunger, respectively, and both at circumferentially equal intervals, in accordance with the above arrangement of the three rollers on the roller holder.

With this arrangement, when the timer piston 60 of the injection timing control device T is moved leftward as indicated by the arrow A in FIG. 4, the eccentric connecting member 50 is correspondingly pivoted clockwise, accompanied by clockwise rotation of the roller holder 40, to obtain an advance in the injection timing.

Although the present embodiment is applied to an injection pump for three-cylinder engines, provided with three rollers, the invention is not limited to such type, but may of course be applied to five-cylinder type or six-cylinder type.

According to the invention, an injection pump can be obtained which is adapted to engines with any number of cylinders merely by adding slight alterations to a conventional distributor type fuel injection pump. Further, in the case of three-cylinder type, a large circumferential interval between adjacent rollers, e.g. 120 degrees, can be obtained, permitting free designing of the camming surface of the cam disc, etc. and providing greatly advantageous results in respect of the cam lift, the maximum rpm, the maximum injection timing advance, etc. Moreover, the invention provides further excellent results such as a reduction in the number of man-hour for machining of the slits in tip of the plunger, etc. leading to a reduction in the manufacturing cost, and improved airtightness between the plunger and the plunger barrel.

Obviously many modifications and variations of the present invention are possible in the light of the above teachings. It is therefore to be understood that within the scope of the appended claims the invention may be practiced otherwise than as specifically described.

What is claimed is:

1. A distributor type fuel injection pump for an internal combustion engine, comprising: a pumping plunger; a drive shaft disposed for rotation at speeds dependent upon the rotational speed of the engine; a cam disc having a camming surface, said cam disc being secured to said plunger and coupled to said drive shaft for rotation in unison therewith; a roller holder disposed for circumferential displacement about an axis thereof; a plurality of rollers carried by said roller holder in radial arrangement, said rollers being disposed in urging contact with said camming surface of said cam disc; injection timing control means having an element displaceable in response to the rotational speed of the engine; and means connecting said roller holder with said displaceable element of said injection timing control means, said connecting means including an eccentric member comprising a first portion and a second portion combined together in eccentricity with each other, said first portion engaging with said roller holder and supporting a predetermined one of said rollers rotatably fitted thereon, said second portion engaging with said displaceable element of said injection timing control means; wherein displacement of said displaceable element of said injection timing control means causes circumferential displacement of said roller holder through said eccentric member of said connecting means, to thereby change the injection timing of fuel into the engine.

2. A distributor type fuel injection pump as claimed in claim 1, wherein said roller holder includes an annular inner holding portion and an annular outer holding portion arranged in concentricity with each other, said inner and outer holding portions having one side surfaces thereof formed with a pair of slits at a predetermined location opposite said displaceable element, said slits extending radially of said roller holder and disposed opposite each other, said first portion of said eccentric member having opposite end portions fitted in said slits, said predetermined roller being rotatably supported on said first portion of said eccentric member and interposed between said inner holding portion and said outer holding portion of said roller holder.

3. A distributor type fuel injection pump as claimed in claim 2; further including a snap ring forcedly interposed between said predetermined roller and said outer holding member of said roller holder.

4. A distributor type fuel injection pump as claimed in claim 3, wherein said snap ring has a central through hole, an outer peripheral edge, a side surface tapered from a location in the vicinity of said central through hole to said outer peripheral edge, and a side opening extending from said outer peripheral edge to said central through hole, whereby said snap ring is force fitted onto said first portion of said eccentric member through said side opening.

5. A distributor type fuel injection pump as claimed in claim 3, wherein said first portion of said eccentric member has an annular groove circumferentially extending thereof at a predetermined location, said snap ring being force fitted in said annular groove.

6. A distributor type fuel injection pump as claimed in claim 1, wherein said displaceable element of said injection timing control means includes a peripheral surface opposite said roller holder, an engaging hole formed in said peripheral surface, and a holder pivotably received within said engaging hole, said second portion of said eccentric member being fitted in said holder.

7. A distributor type fuel injection pump as claimed in claim 1, wherein said roller holder and said displaceable member of said injection timing control means have axes thereof disposed substantially at right angles to each other, the direction of eccentricity of said first and second portions of said eccentric member being substantially identical with the axis of said roller holder.

8. A distributor type fuel injection pump as claimed in claim 1, wherein said eccentric member is formed of a one-piece member.

* * * * *